US006192814B1

(12) United States Patent
Beverly

(10) Patent No.: US 6,192,814 B1
(45) Date of Patent: Feb. 27, 2001

(54) CUT PILE TUFTING MACHINE CUTTING ELEMENTS

(75) Inventor: Ian Beverly, Blackburn (GB)

(73) Assignee: Spencer Wright Industries, Inc., Dalton, GA (US)

( * ) Notice: Under 35 U.S.C. 154(b), the term of this patent shall be extended for 0 days.

(21) Appl. No.: 09/489,411

(22) Filed: Jan. 21, 2000

(30) Foreign Application Priority Data

Oct. 20, 1999 (GB) ..... 9924840.3

(51) Int. Cl.[7] ..... D05C 15/22; D05C 15/24
(52) U.S. Cl. ..... 112/80.55
(58) Field of Search ..... 112/80.6, 80.5, 112/80.51, 80.52, 80.54, 8.55, 80.56, 80.58, 80.7, 80.71

(56) References Cited

U.S. PATENT DOCUMENTS

| | | | | |
|---|---|---|---|---|
| 2,318,200 | * | 5/1943 | Cobble et al. | 112/80.55 X |
| 3,152,563 | * | 10/1964 | Broadrick | 112/80.55 |
| 3,880,101 | | 4/1975 | Passons . | |
| 4,155,318 | * | 5/1979 | Yamamoto | 112/80.55 |
| 5,738,027 | * | 4/1998 | White | 112/80.55 |

FOREIGN PATENT DOCUMENTS

| | | |
|---|---|---|
| 2182681 | 6/1986 | (GB) . |
| 587094 | 6/1993 | (GB) . |

* cited by examiner

*Primary Examiner*—Ismael Izaguirre
(74) *Attorney, Agent, or Firm*—Alan Ruderman; Stephen J. Stark

(57) ABSTRACT

The hooks of a cut pile tufting machine have a cam or chamfer surface in the form of an inclined ramp in the shank of the hook adjacent the throat extending to the cutting edge, the hooks being positioned in a hook module with a dual or compound angle relatively to the body of the module. The knife which cooperates with the hook to cut loops of yarn seized by the hook is positioned vertically relatively to the hook but is tilted relatively to the hook. The hook is inclined horizontally toward the knife and is tilted vertically away from the knife. The result is that initial knife tension against the hook is substantially eliminated while additional knife tension is created during the cutting stroke. The vertical positioning of the knife and the angular positioning of the hook away from the knife results in substantially eliminating J-cutting. The hook is preferably inclined horizontally approximately 2° toward the knife, inclined vertically approximately 2° from the knife and the knife is tilted approximately 2° horizontally toward the hook.

19 Claims, 1 Drawing Sheet

CUT PILE TUFTING MACHINE CUTTING ELEMENTS

BACKGROUND OF THE INVENTION

This invention relates to a cut pile tufting machine cutting system and more particularly to tufting machine hooks mounted within a hook module at a compound angle to improve cutting and to reduce J-cutting.

In the production of cut pile tufted fabric, each reciprocating needle cooperates with a hook which seizes a loop of yarn from the needle and holds the loop until it is cut by a knife acting in scissors-like fashion against the side of the hook to form the pile. The cutting action occurs as the hook and knife oscillate along different paths. Conventionally, hooks were mounted within a hook bar and the knives mounted within a knife bar. More recently, the hooks are mounted in modular form within a modular body member and the knives likewise may be mounted in such module form. The modules are molded about the shanks of the respective hooks or knives so that each is properly aligned with respective other hooks and knives. Since the knives act against the face of the respective hooks in scissors-like fashion with sufficient pressure, the knife block or the knife module is pivoted on the bar to which it is attached to engage the face of the hook at a compound angle, i.e., an angle of inclination, and an angle of canter. An angle of inclination of 8° and an angle of canter of approximately 4° has been used in the prior art. The combination of the angle of inclination and the angle of canter provides a compound angle between the knives and the respective hooks. Cutting action requires that there be tension or pressure of the knife against the hook in a sufficient amount so as to obtain the scissors-like cutting. The required initial tension or loading of the knife against the hook has required the knife bar or module to be adjusted so that the knife actually flexes or bends due to the loading or force between the knife and the hook. This results in a high force or load on the knife and results in rapid knife wear and also in wear of the cooperating surfaces of the hook.

There are limitations on the loading of the knife against the hook since cutting occurs at a location adjacent to the throat of the hook and if contact occurs between the surface of the knife below the cutting edge and the surface of the hook behind the throat, the knife is said to be "heeling" against the hook and cutting either ceases or very rough cutting occurs. Moreover, the range of tension on the knife is limited in very fine gauge tufting machines since a knife may contact an adjacent hook. In such fine gauge machines, a knife relief may be ground into the surface of the hook remote from the cutting surface to prevent or minimize such interference. Consequently, the required knife tension during cutting is difficult to attain with hooks of the prior art. Moreover, in fine gauge machines, the thickness of the yarns that may be cut may be limited because of the limitations on the tension that can be applied between the knives and the hooks.

Another major problem encountered during cutting in a tufting machine results from the fact that the knives act against one face of the hook, and since the hook has a thickness, the leg of the yarn cut against the cutting surface of the hook is shorter than the other leg by an amount substantially equal to the thickness of the hook. This is known as "J cutting." Thus, the pile fabric produced has unequal lengths projecting from the backing material and requires excessive tip shearing.

In Cox, U.S. Pat. No. 4,602,576, a proposal was made to remedy the aforesaid problems by proposing a hook having an inclined ramp on the face of the hook adjacent to the cutting edge, the ramp being a relief in the surface which acts as a cam surface to direct the knife as the knife oscillates adjacent to the throat of the hook. The cam surface is ground at an angle relative to the blade of the hook to increase the distance between the surface of the knife below the cutting edge and the surface of the hook behind the throat and to permit greater tension to be applied between the knife and the hook without resulting in "heeling" of the knife against the hook. As the flexed knife rides up the cam surface the distance between these surfaces will actually increase resulting in an increase in tension as the cutting edges approach each other. The proposal also was to provide an additional relief on the cutting edge of the hook as a continuation of the cam surface or at a slightly different slope to place the cutting edge substantially between the opposed surfaces of the blade of the hook in an effort to eliminate the "J" cutting problem. However, after unsuccessful attempts were made to develop hooks constructed in accordance with this proposal, efforts were abandoned.

SUMMARY OF THE INVENTION

The reasons for the lack of success of the proposal in the aforesaid U.S. patent have now been recognized. The present invention, to overcome the failures of the prior art, proposes to position hooks having a cam or chamfer surface in the form of an inclined ramp in the shank adjacent the throat to the cutting edge of the hook in a hook mounting such as a module with a dual or compound angle and maintaining the knife substantially vertical with no vertical inclination and with a small canter. The compound angle of the hook results from inclining the hook horizontally toward the knife and tilting it vertically away from the knife. The result is that initial knife tension with the hook is substantially eliminated while additional knife tension is created during the cutting stroke as the knife rides up the cam or chamfer surface of the hook. Further, J-cutting is reduced. Other advantages include easier loading of the knives into the tufting machine, easier knife grinding especially with knife modules, and elimination of knife heeling. Significantly, because of the lower initial tension and the vertical position of the knives there is still good cutting action in finer gauge cut pile machines. Moreover, with the knife vertical, the cutting area will remain clear which aids in providing good cutting action and as the machine operates.

In the preferred embodiment, the hook is inclined horizontally approximately 2° toward the knife and inclined or cantered vertically approximately 2° from the knife, while the knife remains vertical but is tilted approximately 2° horizontally toward the hook.

Consequently, it is a primary object of the present invention to provide a hook and knife constructed for a cut pile tufting machine which substantially eliminates initial knife tension with the hook and which creates additional knife tension during the cutting stroke.

It is another object of the present invention to provide a hook and knife construction for cut pile tufting machines which reduces substantially J-cutting.

It is further object of the present invention to provide a hook and knife construction for a cut pile tufting machine which permits better cutting action in fine gauge tufting machines.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

Figure 1:
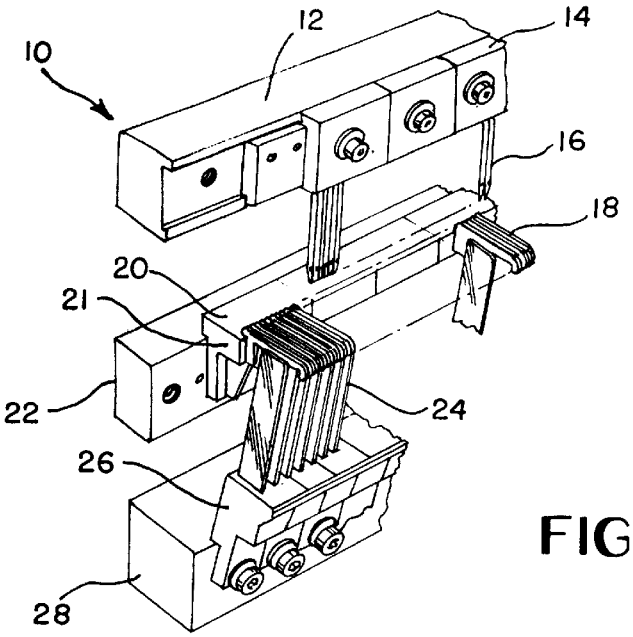
FIG. 1 is a fragmentary perspective view of a portion of a tufting machine illustrating the stitching and cutting instrumentality in modular form.

Referring to the drawings, a portion of a cut pile tufting machine 10 is illustrated having a needle bar 12 carrying a plurality of needle modules including a body member 14 and a plurality of needles 16 extending therefrom mounted for reciprocating into cooperation with a respective oscillating hook 18 preferably mounted within a module having a body member 20 which is fastened to a hook bar 22 for seizing loops of yarn from the needles, the body member having spaced apart parallel sides 21 adapted to substantially abut similar sides of adjacent modules as illustrated in FIG. 1. Cooperating with the hooks in scissors-like fashion is a respective knife 24 mounted in a knife module body member 26 secured to a knife bar 28 which oscillates in timed relationship with the oscillation of the hooks to cut the loops on the respective hooks.

Each hook 18 includes an elongated blade or bill 30 having a beak 32 at the free end thereof extending from a throat 34 formed at the junction of the blade 30 with a shank 36 having a mounting portion which is molded within the body member 20. The underside of the bill 30 adjacent to and extending slightly from the throat 34 has a sharpened bottom edge 38 which conventionally acts as a ledger blade in cooperation with the oscillating knife 24 to cut loops of yam on the bill as they approach the throat. The portion of the shank adjacent the throat is ground at an incline or chamfer to form a ramp or cam surface 40 which terminates at an edge 42 which is a continuation of the cutting edge of the blade, i.e., the intersection between the bottom edge 38 and the throat 34.

Figure 2:
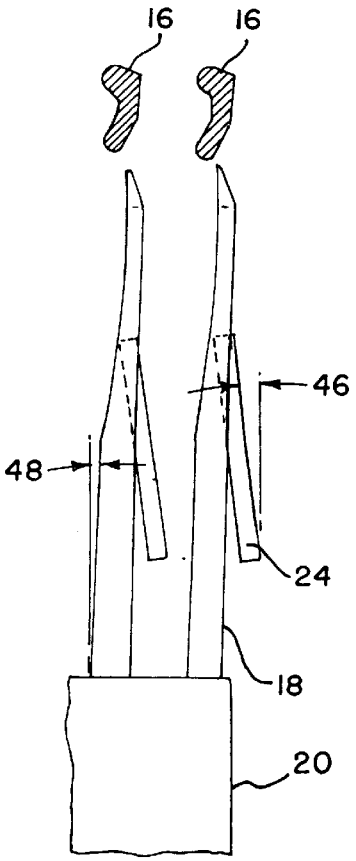
FIG. 2 is a horizontal cross-sectional view of portion of the apparatus illustrated in FIG. 1.
Figure 4:
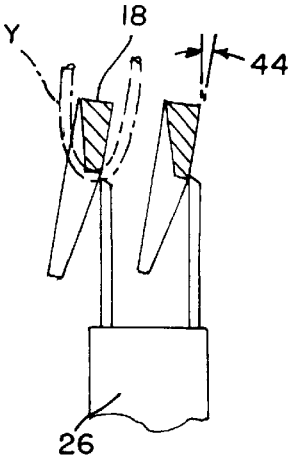
FIG. 4 is a diagrammatic cross-sectional view illustrating the cutting action of the knife on the hook.
Figure 5:
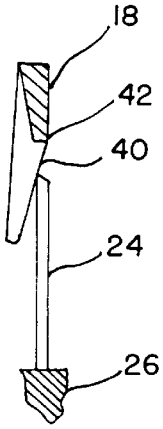
FIG. 5 is a diagrammatic cross-sectional view illustrating the initial vertical position of a knife against the cam surface of the hook illustrated in FIG. 3.
Figure 6:
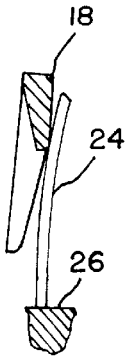
FIG. 6 is a view similar to FIG. 5 but illustrating the increase in tension on the knife as it travels up the hook cam or chamfer surface.

As illustrated in FIGS. 4 through 6, the knives are positioned vertically in the knife module bodies 26 and engage the ramp or cam surface 40 as illustrated in FIG. 5 with very little if any initial tension. As the knife rides up the ramp, the tension is increased as illustrated in FIG. 6 and the knife may actually bend slightly. The hooks, however, in the vertical plane, as illustrated in FIG. 4, have a small angular disposition 44 relatively to the modules in which they are mounted and the knife modules, this angle being approximately 2° away from the knife in the preferred embodiment so as to reduce J-cutting and to provide additional knife tension as the knife moves upwardly during its cutting stroke. As illustrated in FIG. 4, a loop of yam Y when cut is cut at the cutting edge which is at a location which is substantially halfway between the legs of the loop. In the horizontal plane, as illustrated in FIG. 2, the knives are cantered so as to provide a scissors action with the hooks, the angle of the canter 46 being approximately 2° in the preferred embodiment. Moreover, the hooks are set in the module at a horizontal angular inclination 48 toward the knife as illustrated in FIG. 2, this inclination being approximately 2° in the preferred embodiment.

Figure 3:
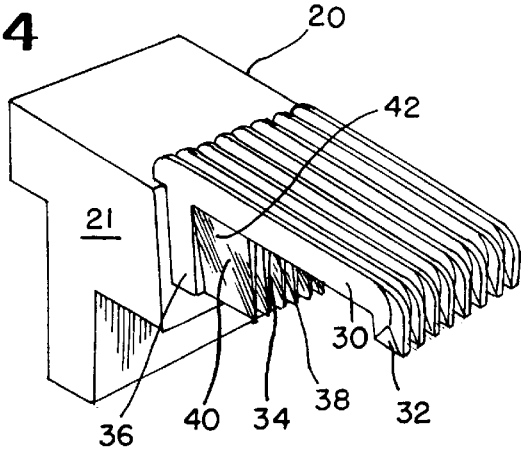
FIG. 3 is a perspective view of a hook module constructed in accordance with the present invention.

Since the knives are vertical, and since the needles reciprocate in a common vertical plane, the angle that the knives are cantered or twisted places them at a slight canter angle relative to that plane, the canter is at an angle to the parallel planes within which the respective needles reciprocate. Moreover, as illustrated in FIG. 2, the hooks are at a slight angle to the path or planes of reciprocation of the needle and toward the knives. The hooks also, as illustrated in FIGS. 3 through 5, are at a slight angle to the plane of the needles, i.e., the plane in which all the needles lie, and also away from the knives.

With this construction, since there is little or no initial tension, it is substantially easier to load the knife modules into the tufting machine. It is also easier to grind the knives since there is only a single angle at which it needs to be ground. The vertical disposition of the knives help to keep the cutting area clean since there is more space for yarn lint to disburse, and this provides for better cutting action as the process proceeds. Because of the vertical setting of the knives relative to the hooks, "heeling" of the knife against the hook, i.e., contact between the surfaces of the knife below the cutting edge and the surface of the hook behind the throat, should not occur. As aforesaid, J cutting will be substantially reduced by utilizing a vertical knife and a small angular disposition of the hook away from the knife.

Numerous alternations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A cut pile hook for use in a tufting machine for cooperating with a vertically reciprocating needle and a vertically disposed knife, said hook having a bill and a shank, said shank including a mounting portion mounted such that said hook is inclined vertically relatively to said knife at an angle away from said knife and is inclined horizontally relatively to said knife at an angle toward said knife, said bill extending from said shank to define a throat therebetween, and a cam surface formed in said shank adjacent to said throat defining an inclined ramp extending from a first thickness adjacent said throat to a lesser thickness away from said throat so that J-cutting is reduced substantially and initial knife tension against said hook is substantially eliminated but increased when said hook rides up the ramp.

2. A cut pile hook as recited in claim 1, wherein said angle away from said knife is approximately 2°.

3. A cut pile hook as recited in claim 1, wherein said angle toward said knife is approximately 2°.

4. A cut pile hook as recited in claim 1, wherein said mounting portion is disposed within a body member of a hook module carrying a plurality of hooks.

5. A cut pile hook as recited in claim 4, wherein said angle away from said knife is approximately 2°.

6. A cut pile hook as recited in claim 4, wherein said angle toward said knife is approximately 2°.

7. A cut pile hook module comprising a body member having spaced apart parallel sides, a plurality of spaced apart hooks including a substantially planar bill and shank carried by said body member intermediate said sides, each shank including a mounting portion disposed within said body member with said bill inclined at a compound angle relatively to said sides of said module, said bill extending from said shank to define a throat therebetween, and a cam surface formed in said shank adjacent to said throat defining an inclined ramp extending from a first thickness adjacent said throat to a lesser thickness away from said throat.

8. In a cut pile tufting machine, a plurality of vertically disposed needles for reciprocating into cooperation with respective hooks, and a substantially planar knife cooperating with a respective hook for cutting loops of pile seized by the hooks, each knife being carried in a mounting member and disposed in a vertical plane, each hook having a bill and a shank, said shank including a mounting portion mounted such that said hook is inclined vertically relatively to said knife at an angle away from said knife and is inclined horizontally relatively to said knife at an angle toward said knife, said bill extending from said shank to define a throat therebetween, and a cam surface formed in such shank adjacent to said throat defining an inclined ramp extending from a first thickness adjacent said throat to a lesser thickness away from said throat.

9. In a cut pile tufting machine as recited in claim 8, wherein said angle away from said knife is approximately 2°.

10. In a cut pile tufting machine as recited in claim 8, wherein said angle toward said knife is approximately 2°.

11. In a cut pile tufting machine as recited in claim 8, wherein the bill of each hook comprises a substantially planar surface, and the vertical planes in which said knives are disposed are inclined at an angle to the planar surfaces of the hooks.

12. In a cut pile tufting machine as recited in claim 11, wherein said angle away from said knife is approximately 2°.

13. In a cut pile tufting machine as recited in claim 11, wherein said angle toward said knife is approximately 2°.

14. In a cut pile tufting machine as recited in claim 13, wherein said angle away from said knife is approximately 2°.

15. In a cut pile tufting machine as recited in claim 8, wherein said mounting portion is disposed within a body member of a hook module carrying a plurality of hooks.

16. In a cut pile tufting machine as recited in claim 15, wherein said body member has spaced apart substantially parallel sides, and said hooks are disposed within said body member with said bills inclined at a compound angle relatively to said sides.

17. In a cut pile tufting machine as recited in claim 16, wherein said angle away from said knife is approximately 2°.

18. In a cut pile tufting machine as recited in claim 16, wherein said angle toward said knife is approximately 2°.

19. In a cut pile tufting machine as recited in claim 16, wherein the bill of each hook comprises a substantially planar surface, and the vertical planes in which said knives are disposed are inclined at an angle to the planar surfaces of the hooks.

* * * * *